US007632155B1

(12) United States Patent
Wu

(10) Patent No.: US 7,632,155 B1
(45) Date of Patent: Dec. 15, 2009

(54) CABLE CONNECTOR ASSEMBLY WITH IMPROVED TERMINATION DISPOSITION

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/220,307

(22) Filed: Jul. 22, 2008

(51) Int. Cl.
*H01R 24/00* (2006.01)

(52) U.S. Cl. ..... 439/660; 439/497; 439/884

(58) Field of Classification Search ..... 439/95–98, 439/493, 497, 607.05, 660, 884
See application file for complete search history.

(56) References Cited

U.S. PATENT DOCUMENTS 6,447,340 B1 9/2002 Wu
6,454,605 B1 9/2002 Bassler et al.
7,052,292 B2 5/2006 Hsu et al.
7,390,220 B1 * 6/2008 Wu ..... 439/607.06
7,462,071 B1 * 12/2008 Wu ..... 439/607.05

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

A connector for connecting to at least a cable (5), includes an insulated housing (2); a plurality of contacts (31, 32) supported by the insulated housing (2), said contacts including at least two pairs of signal contacts (31) and at least a grounding contact (32); said signal contacts (31) divided into two juxtaposed differential contact pairs (310); each of the differential contact pairs (310) including a first signal contact (310A) and a second signal contact (310B) juxtaposed closely to each other; each of the first and second signal contacts (310A, 310B) having a retention portion, a mating portion extending forward from the retention portion and a tail portion extending rearward from the retention portion, and a first side (3101) and a second side (3103) which are divergent from a front segment of the retention portion to an free end of the mating portion such that a first distance (30') between the retention portions of two adjacent differential contact pairs of signal contacts is smaller than a second distance (30) between the mating portions of the same differential contact pairs of signal contacts; and said grounding contact having a mating portion disposed between the mating portions of the two adjacent differential contact pairs.

10 Claims, 12 Drawing Sheets

CABLE CONNECTOR ASSEMBLY WITH IMPROVED TERMINATION DISPOSITION

FIELD OF THE INVENTION

The present invention generally relates to a cable connector assembly, and more particularly to a cable connector assembly having an improved termination disposition.

DESCRIPTION OF PRIOR ART

Many electronic devices rely upon transmission lines to transmit signals between related devices or between peripheral devices and circuit boards of a computer. These transmission lines incorporate signal cables that are capable of high-speed data transmissions.

These signal cables may use what are known as one or more twisted pairs of wires that are twisted together along the length of the cable, with each such twisted pair being encircled by an associated grounding shield. These twisted pairs typically receive complementary signal voltages, i.e., one wire of the pair may see a +1.0 volt signal, while the other wire of the pair may see a −1.0 volt signal. Thus, these wires may be called "differential" pairs, a term that refers to the different signals they carry. At present, HDMI connector is widely used for transmitting signals between a TV and other peripheral device. One of an ordinary HDMI connector has nineteen terminal positions, which are separated into two sets along a vertical direction. The terminals positions are divided into a number of terminals groups, and each terminal group has a differential pair for transmitting signals and a grounding terminal opposite to the differential pair to form a triangular-shaped configuration. However, such arrangement of the terminal dispositions not only increases dimension of an interface of connector, but also has difficult in soldering process, for differential pairs and grounding terminals mingled together, extra effort required to identify them.

The present invention is therefore directed to a termination structure for providing improved connections between cables and connectors that provides a high level of performance and which maintains the electrical characteristics of the cable in the termination area.

SUMMARY OF THE INVENTION

Accordingly, an object of the present invention is to provide a cable connector assembly having an improved termination arrangement.

In order to achieve the object set forth, an electrical contact insert for a cable connector assembly in accordance with the present invention comprises a set of signal contacts including at least two differential contact pairs arranged in juxtaposed; each of the differential contact pairs including a first signal contact and a second signal contact juxtaposed closely to each other; each of the first signal and second signal contacts having a base portion and a contact engaging portion, and a first side and a second side which is divergent from the base portion to an free end of the contact engaging portion such that a first distance between the base portion of two adjacent differential contact pairs of signal contacts is smaller than a second distance between the contact engaging portion of the same differential contact pairs of signal contacts.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
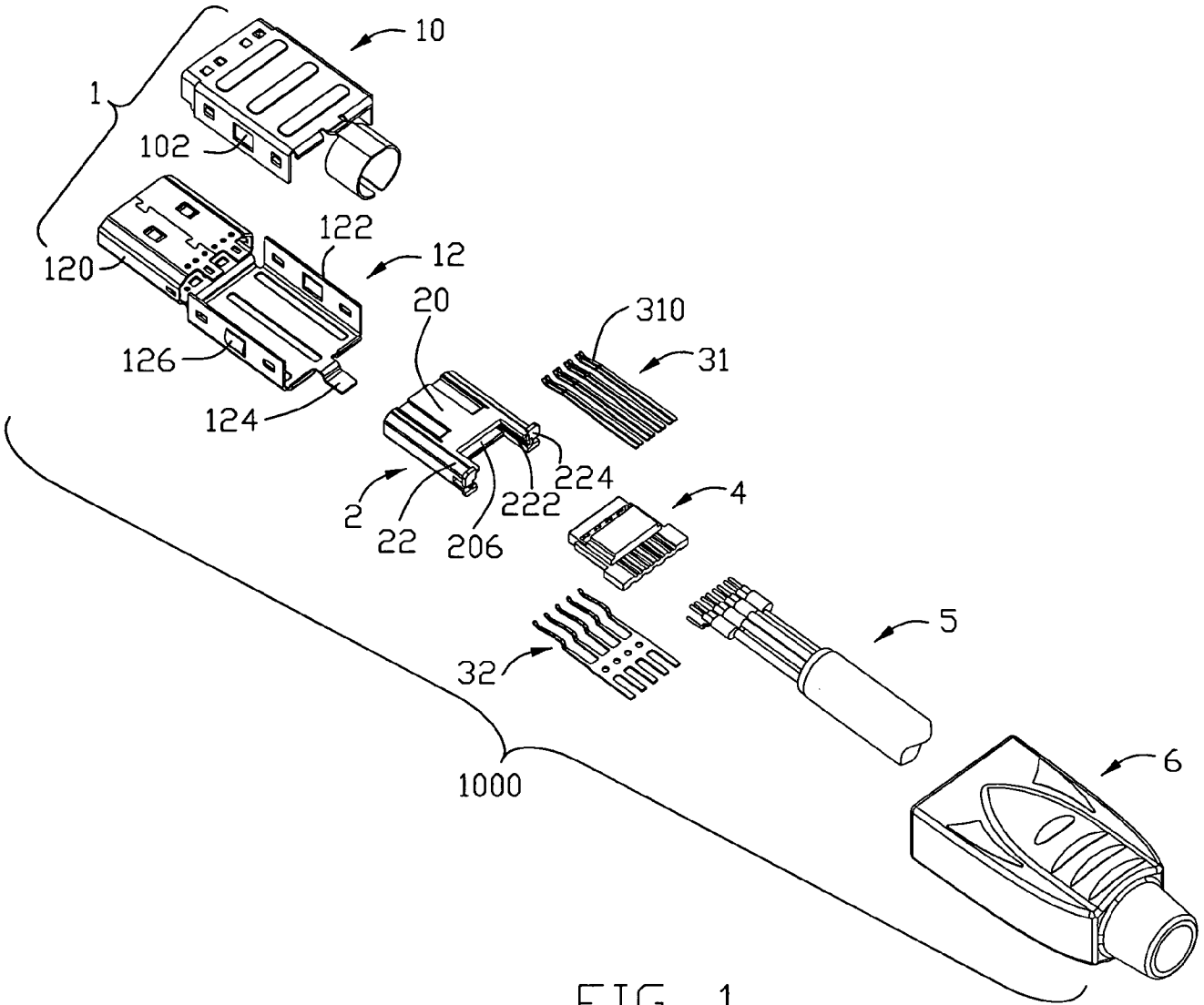
FIG. 1 is an exploded, perspective view of a cable connector assembly.
Figure 2:
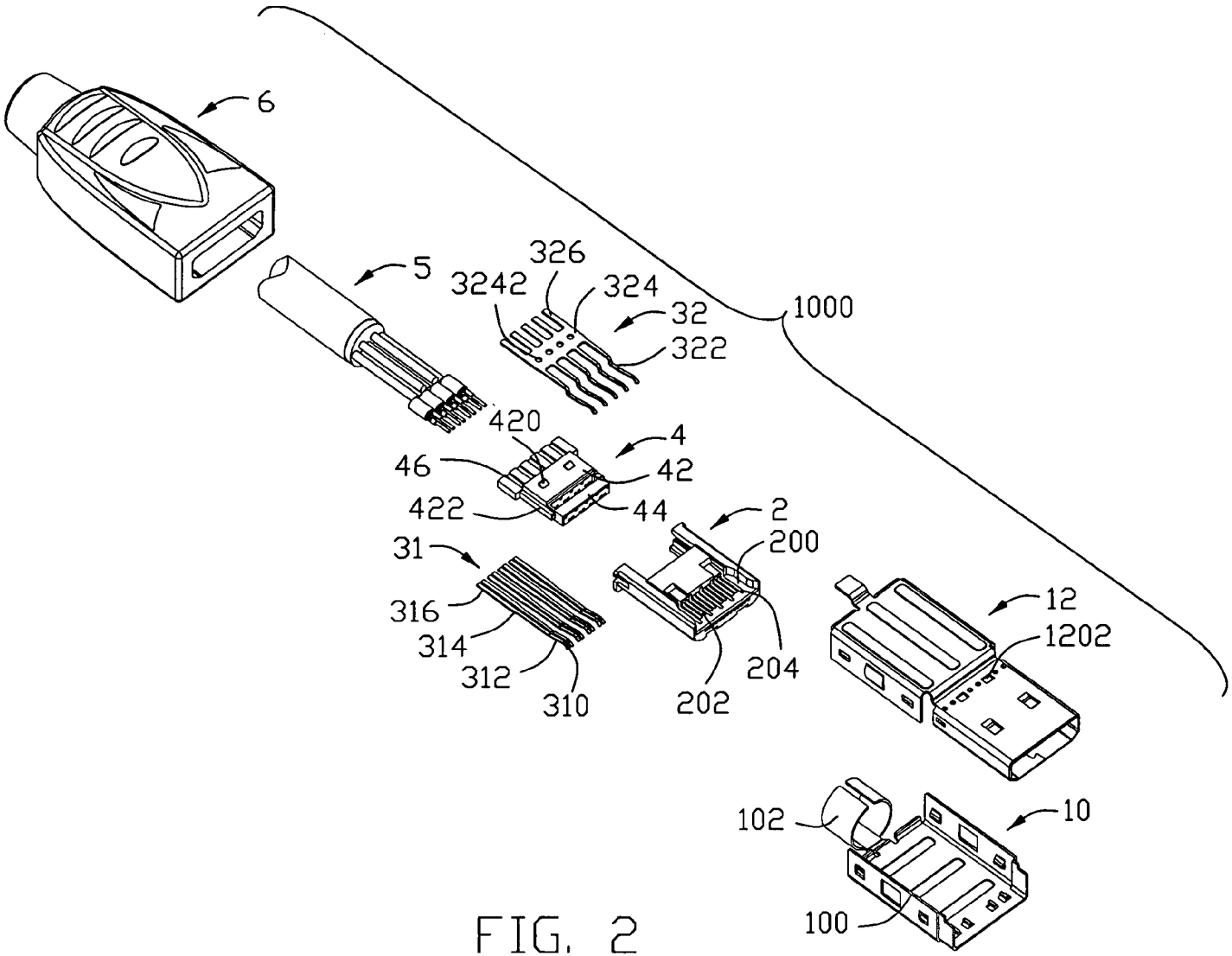
FIG. 2 is similar to FIG. 1, but viewed from another aspect.
Figure 3:
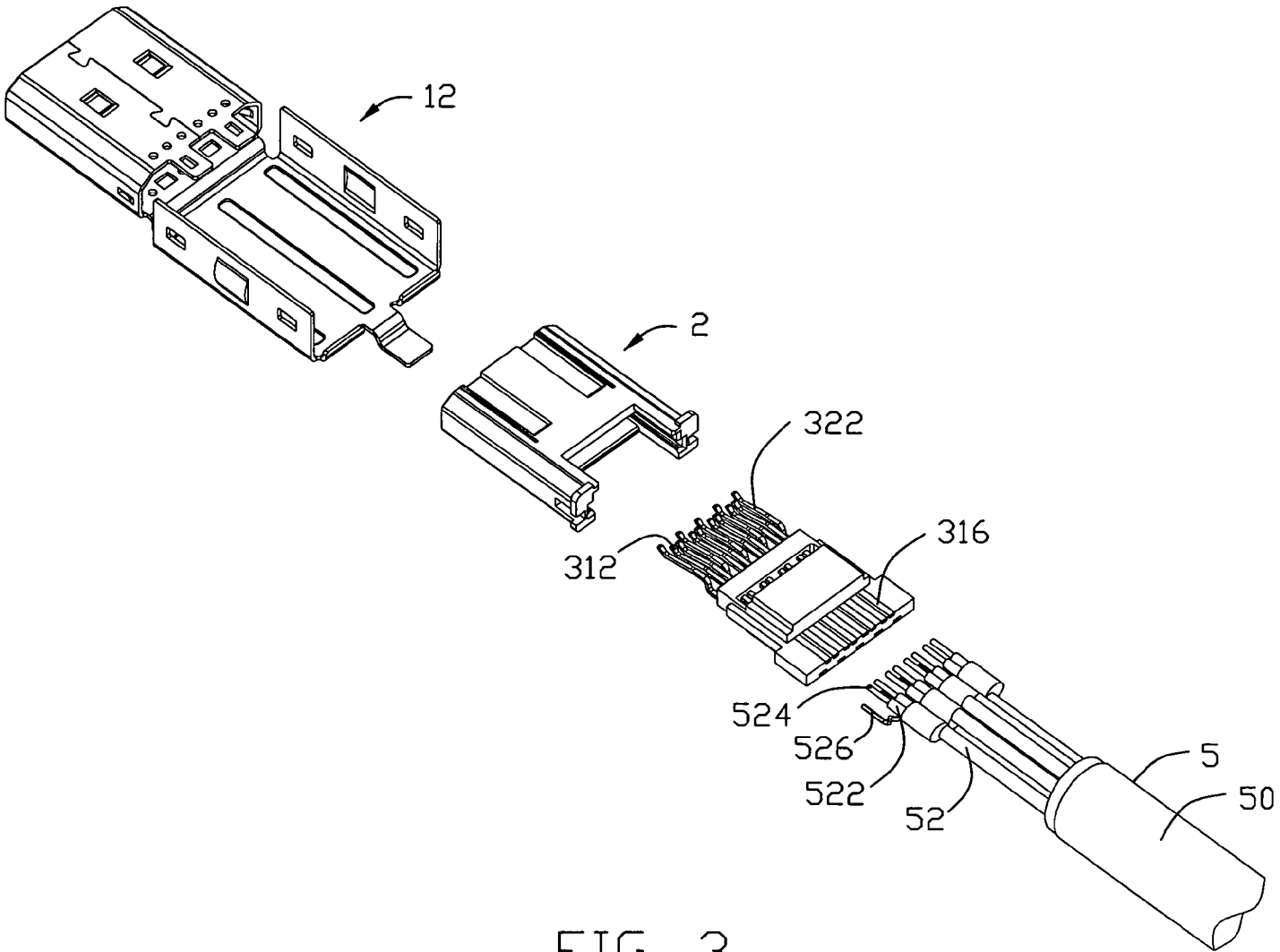
FIG. 3 is a partially assembled view of the cable connector assembly.
Figure 4:
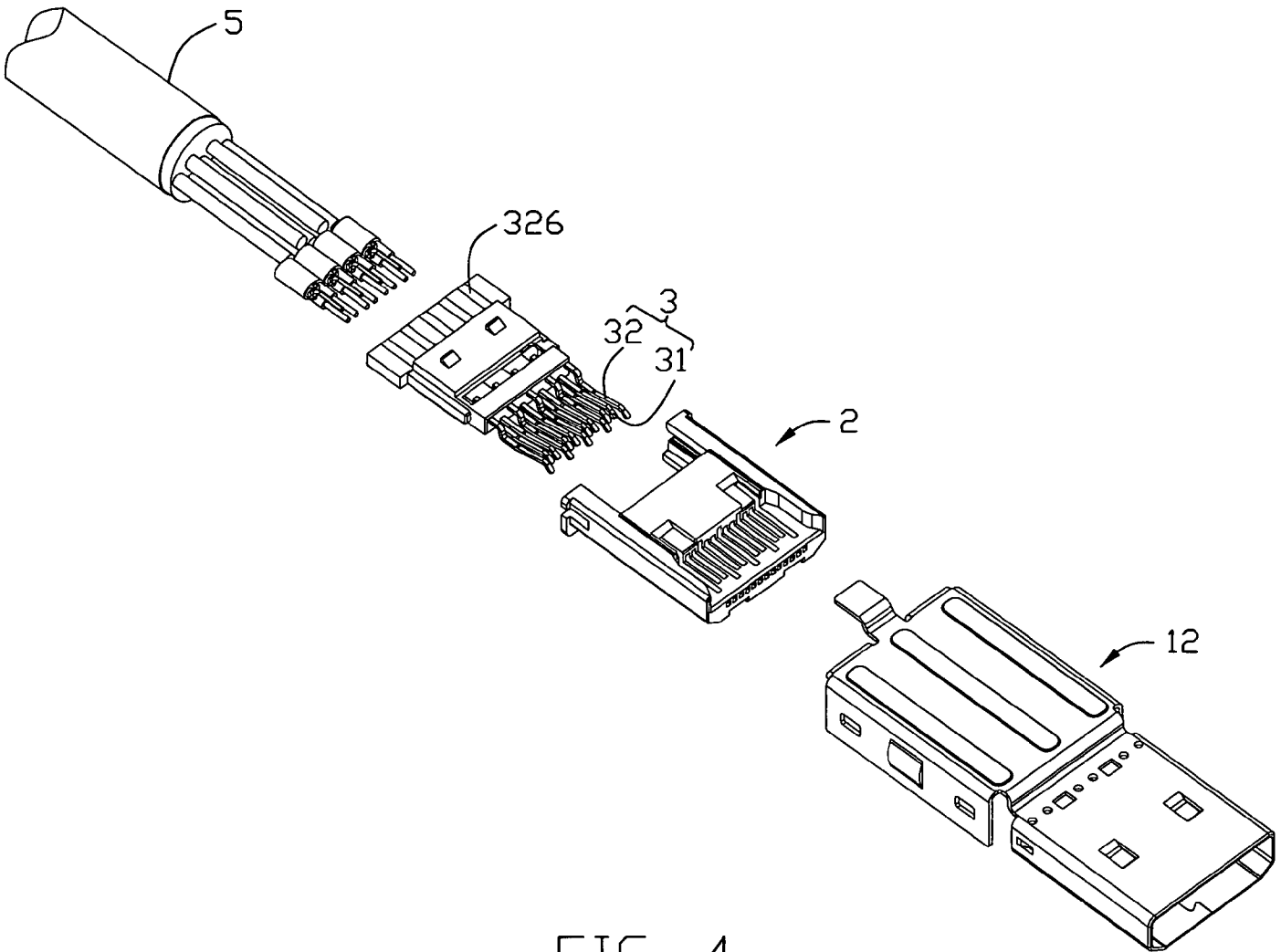
FIG. 4 is similar to FIG. 3, but viewed from another aspect.
Figure 5:
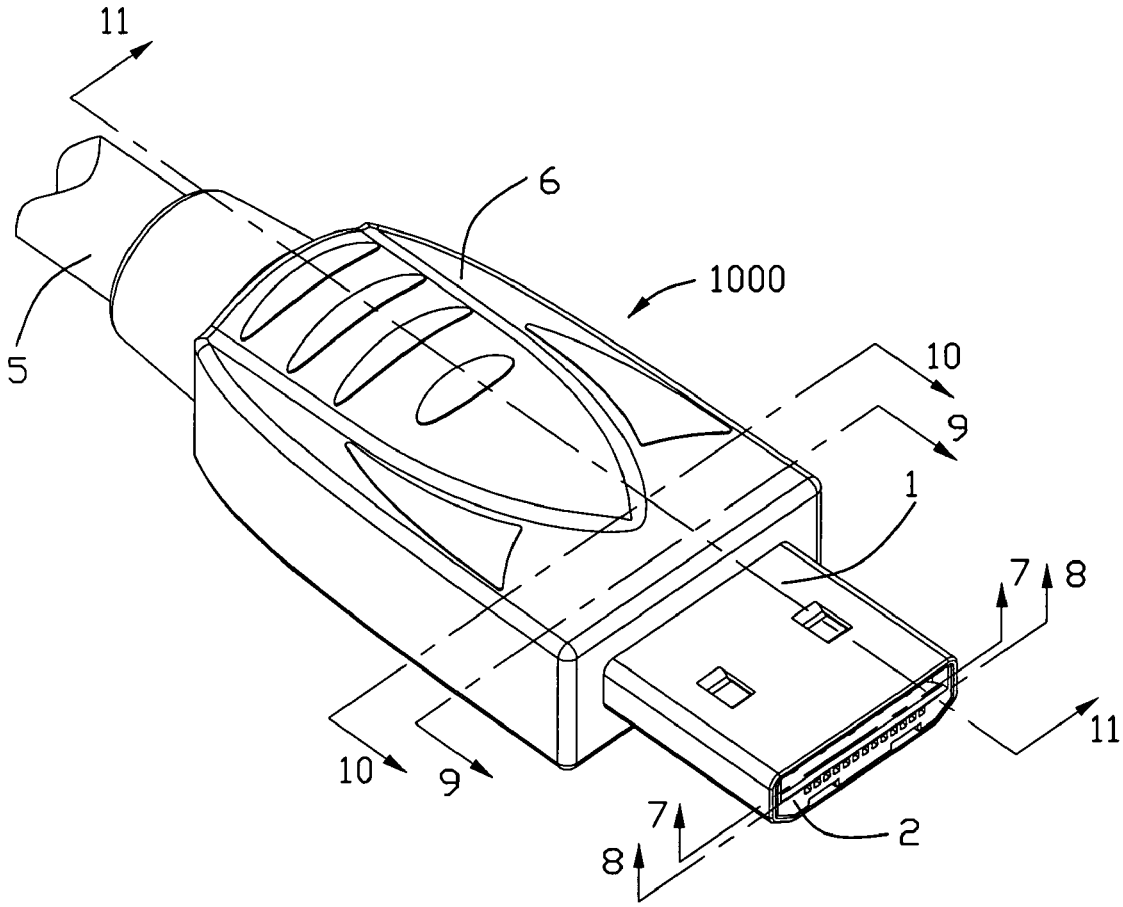
FIG. 5 is an assembled, perspective view of the cable connector assembly.
Figure 6:
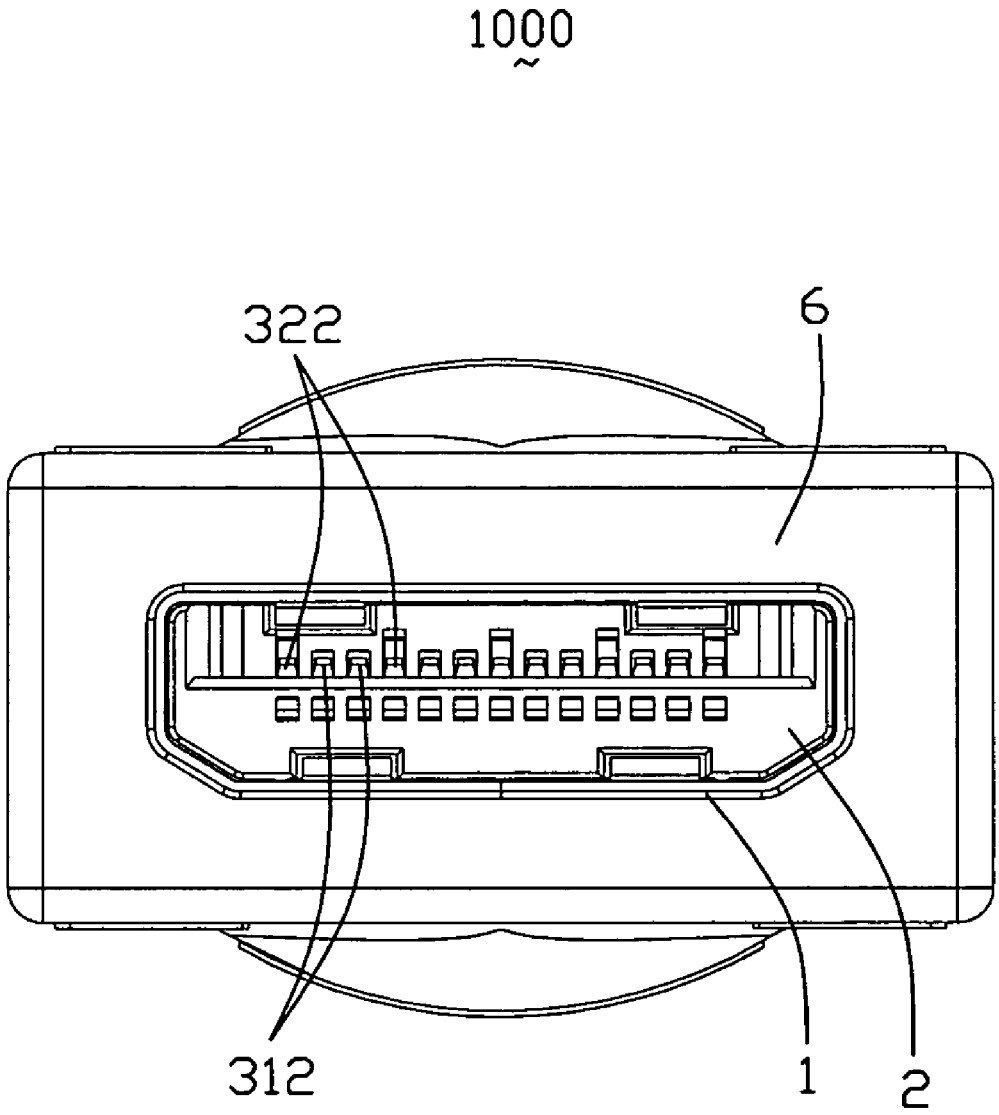
FIG. 6 is a front view of the cable connector assembly.
Figure 7:
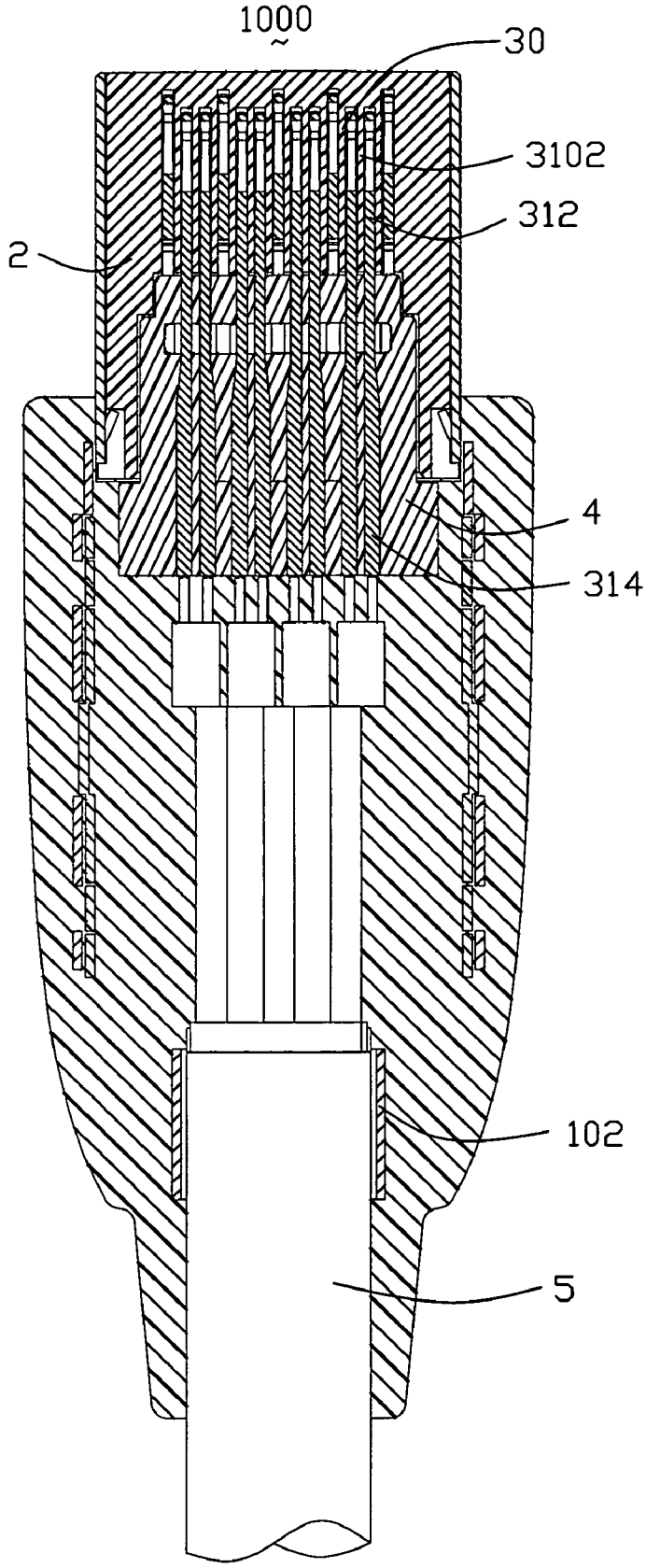
FIG. 7 is a cross-section view taken along line 7-7 of the FIG. 5.
Figure 8:
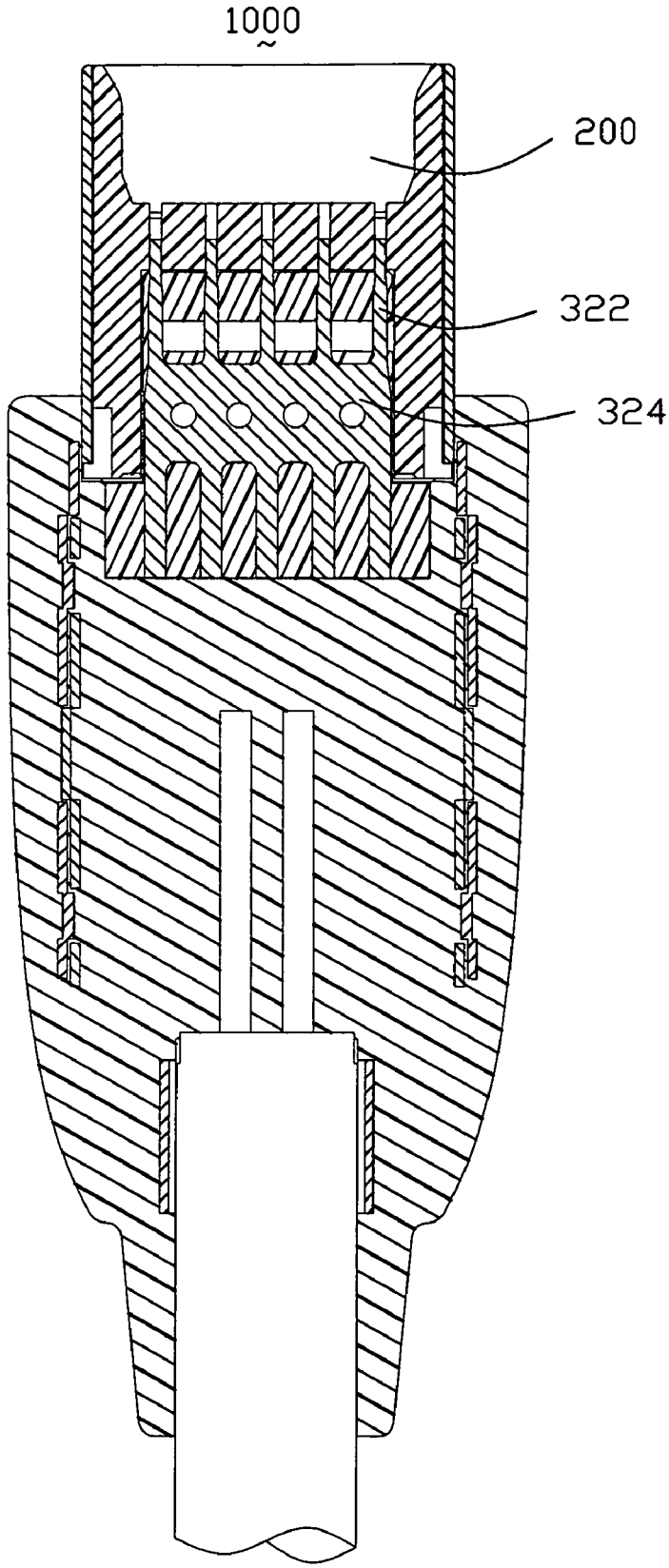
FIG. 8 is a cross-section view taken along line 8-8 of the FIG. 5.
Figure 9:
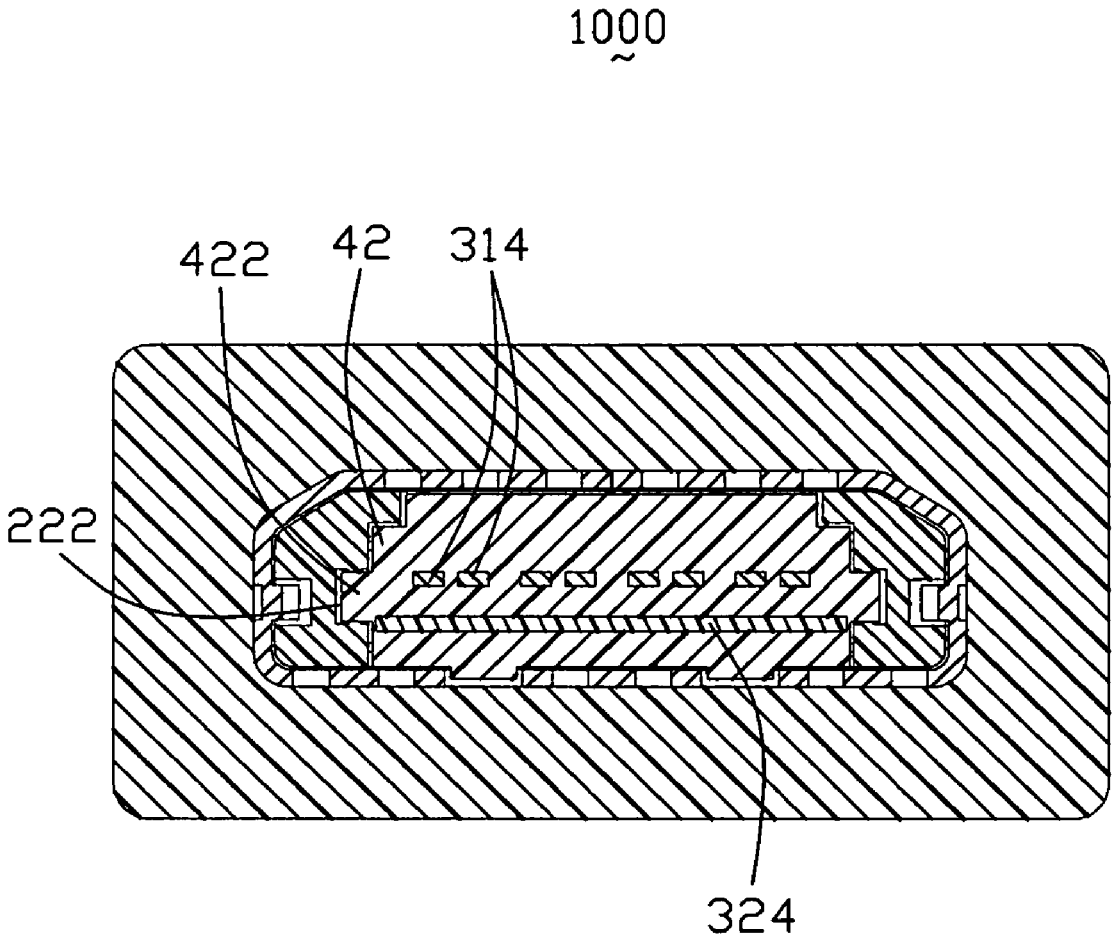
FIG. 9 is a cross-section view taken along line 9-9 of the FIG. 5.
Figure 10:
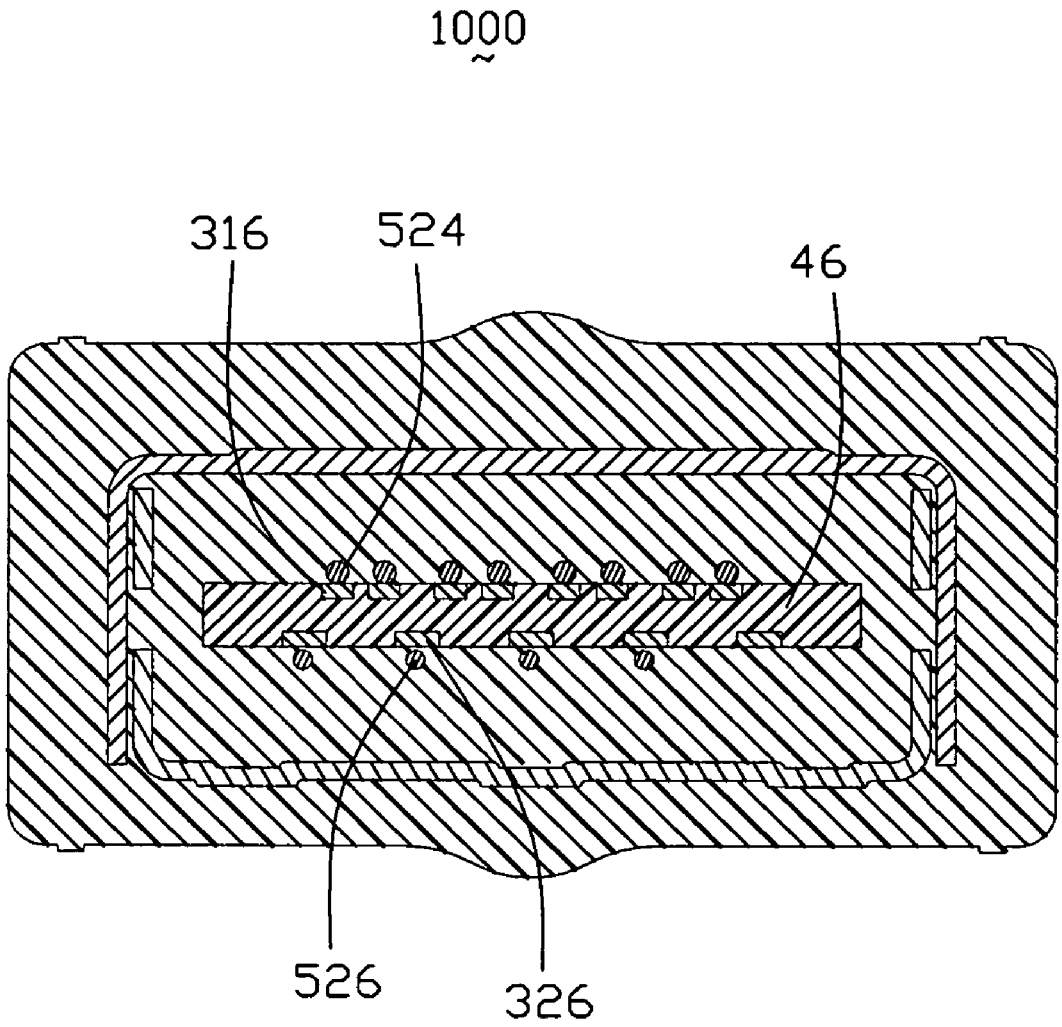
FIG. 10 is a cross-section view taken along line 10-10 of the FIG. 5.
Figure 11:
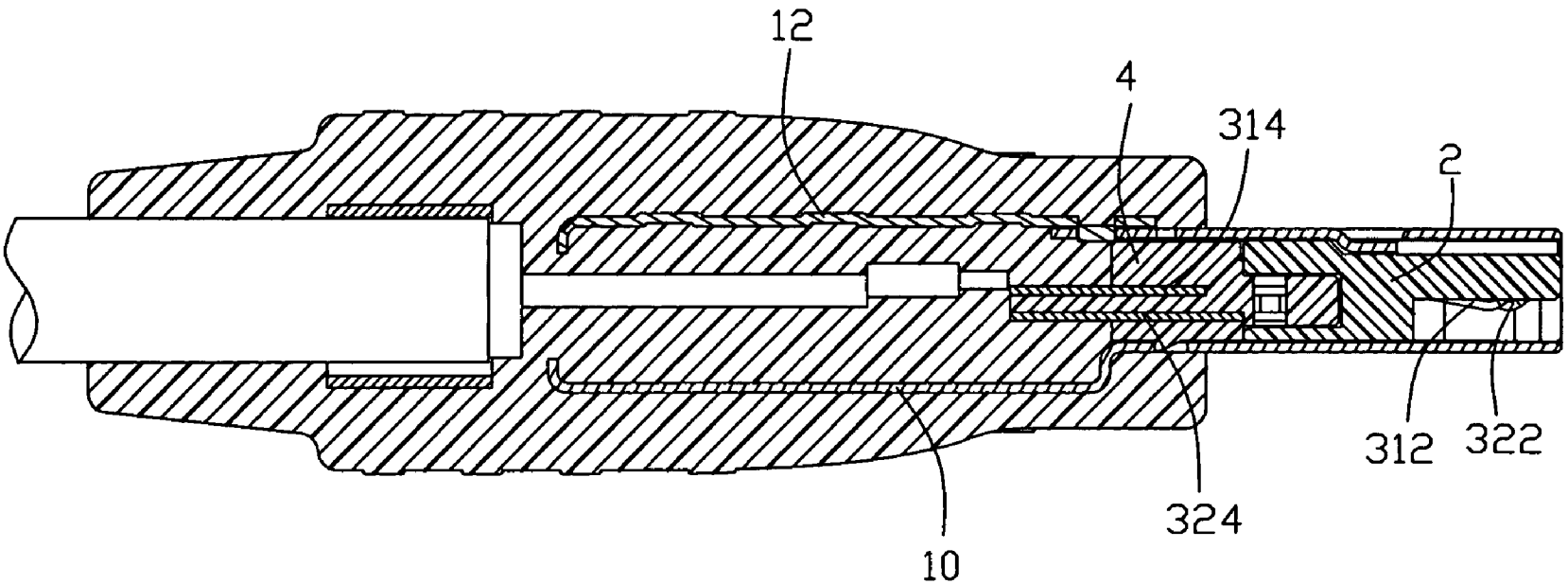
FIG. 11 is a cross-section view taken along line 11-11 of the FIG. 5.
Figure 12:
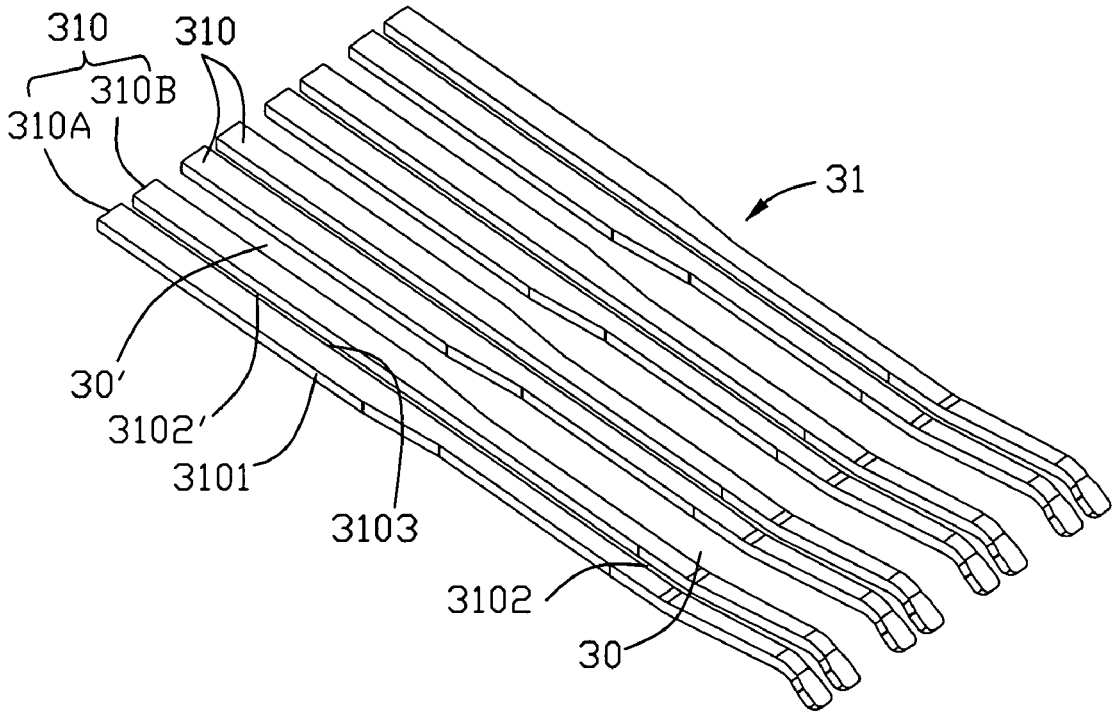
FIG. 12 is an enlarged view of signal contacts showed in FIG. 2.

Referring to FIGS. 1-12, a cable connector assembly 1000 comprises a metallic shell 1, an insulated housing 2, a plurality of contacts 3, a spacer 4, a cable 5 and an insulated cover 6.

The metallic shell 1 includes a first shielding member 10 and a second shielding member 12. The first shielding member 10 has an inverted U-shaped first shielding portion 100 and a cable holder portion 102 coupled to a back edge of an upper side of the first shielding portion 10. The second shielding member 12 has a rectangular-shaped sleeve portion 120 and a U-shaped second shielding portion 122 extending rearward from back edge of a bottom side of the sleeve portion 120. A tab 124 is formed at rear edge of a bottom side of the second shielding portion 122. The first shielding member 10 latches with the second shielding member 12, with protrusions 126 formed on lateral sides of the second shielding portion 122 locked into corresponding holes 102 in lateral sides of the first shielding portion 100.

The insulated housing 2 includes a main portion 20 and two arms 22 extending rearward from lateral sides of a back face of the main portion 20. A sunken port 200 is recess upwardly from a bottom surface of a front segment of the main portion 20. The sunken portion 200 is of U-shaped viewed from a front side (see FIG. 2). Eight first grooves 202 and five second grooves 204 are defined in the sunken portion. The first grooves 202 are divided into four groove sets by the second grooves 204 and each set has two grooves. A cavity portion 206 is recessed forwardly form the back face of the main portion 20. Each arm 22 has a guiding passage 222 defined in an inner portion thereof. A stopper portion 224 is formed at a rear end of each arm 22.

The contacts 3 include eight signal contacts 31 and five grounding contacts 32. Each signal contact 31 has a retention portion 314, a mating portion 312 extending forward from a front portion of the retention portion 314 and a tail portion 316 extending rearward from a back portion of the retention portion 314, thus the tail portion 316 is opposite to the mating portion 312 along a horizontal direction.

The tail portion 316 and a rear segment of the retention portion 314 may be regarded as a base portion of the signal contact 31 which is insert-molded with the spacer 4. While a front segment of the retention portion 314 and the mating portion 312 of the signal contact 31 may be regarded as a contact engaging portion for electrically contacting with corresponding terminal of an complementary connector (not shown).

The eight signal contacts 31 are separated into four groups of differential contact pairs 310 for transmitting differential signals. The four differential contact pairs 310 are arranged in juxtaposed manner. Each differential contact pair 310 includes a first signal contact 310A and a second signal contact 310B juxtaposed closely to each other. The first signal contact 310A and the second signal contact 310B have same structure and are symmetrically disposed along an imaginary central line (not numbered) therebetween. Either the first signal contact 310A or the second signal contact 310B have first side (outside) 3101 with a curve surface and a second side (inner side) 3103 with a planar surface. The first side 3101 and second side 3103 are divergent from the base portion of the first contact 310A or the second contact 310B to an free end of the contact engaging portion thereof, such that a first distance (space) 30' between the base portions of two adjacent differential contact pairs 310 is smaller than a second distance (space) 30 between the contact engaging portions of the same two differential contact pairs 310.

As the mating portion 312 is thinner than the tail portion 314, therefore a first gap 3102 formed between the mating portions 312 of each differential contact pairs 310 is narrower than the second distance 30 between the mating portions 312 of the two adjacent differential contact pairs 310. Furthermore, the first gap 3102 is also narrower than the first distance 30', but is substantially equally to a second gap 3102' between the tail portions 316 of the same differential contact pairs 310. Thus, a distance between the first and second signal contacts 310A, 310B is constant and invariable, and differential signals transmitted along the signal contact pair 310 being parallel to each other, by such arrangement, the signal contacts 31 may reach higher transmitting rate.

Each grounding contact 32 has a retention portion 324, a mating portion 322 extending forward from a front portion of the retention portion 324 and a tail portion 326 extending rearward from a back portion of the retention portion 324. A number of holes 3242 are defined in the retention portion 342. In the present embodiment, the retention portion 324 is configured to a unitary body, with all of the grounding contacts 32 interconnected together; in alternative embodiment, the retention portion 324 together with the tail portion 326 may be in the form of a whole grounding plate and the mating portion 326 may be as grounding fingers integrated with the grounding plate; in another alternative embodiment, the grounding contacts 32 may be divided into several pieces and discrete from each other.

The spacer 4 is an insulator which has a main portion 42, an inserter portion 44 extending forwardly from a front face of the main portion 42, a supporting portion 46 extending rearward from a back face of the main portion 42. A pair of locking members 420 are formed on bottom surface of the main portion 42. Two flange portions 422 are respectively formed at lateral sides of the main portion 42. However, in alternative embodiment, the spacer 4 and the insulated housing 1 may be an one-piece housing unit, rather than separated into two individual pieces as described in previous embodiment.

The contacts 3 is combined with the spacer 4 via insert-mold process. The retention portions 314, 324 embedded in the main portion 42 of the spacer, the tail portions 316, 326 disposed on a top and a bottom surfaces of the supporting portion 46, the mating portions 312, 322 extending through inserter portion 44 and disposed forward of the spacer 4. Furthermore, the mating portions 312 of the signal contact pairs 310 of the signal contacts 31 are mingled with the mating portions 322 of the grounding contacts 32 and merged into a uniform group, unlike the tail portions 316, 326 and retention portions 314, 324 of the signal contacts 31 and grounding contacts 32 separated into two groups and disposed in distinct levels along a vertical direction perpendicular to the horizontal direction. The mating portions 312 of each signal contact pair 310 are accompanied by two mating portions 322 of the grounding contacts 32, and that is to say the mating portions 322 are arranged outside of the mating portions 312 of corresponding signal contact pair 310. A distance (gap) between each adjacent mating portions 312/322 of the contacts 3 is isometric/equal, and such arrangement may achieve better grounding effect.

The cable 5 includes a number of wire pairs 52 for transmitting differential signals and a jacket enclosing the differential wire pairs 52. Each differential wire pairs 52 include two individual wires 522 insulated from one another and a grounding braiding portions 526 shrouding outside of the individual wires 522. The individual wire 522 further has an inner conductor 524.

When assembly, the contacts 3 are first insert-molded with the spacer 4, then the spacer 4 is assembled to the insulated housing 2, with the flange portions 422 sliding along the guiding passages 222 of arms 22, the inserter portion 44 plunged into the cavity portion 206 of the insulated housing 2, the mating portions 312 of the signal contacts 31 disposed in the first grooves 202, the mating portions 322 of the grounding contacts 32 disposed in the second grooves 204; and then the conductors 524 of the cable 5 are soldered to the tail portions 316 of corresponding signal contacts 31, the grounding braiding portions 526 are soldered to the tail portions 326 of the grounding contacts 32. Secondly, the insulated housing 2 is assembled to the sleeve portion 120, with the stopper portions 224 of the arms 22 against a back edge of the sleeve portion 120, the locking members 420 locked into positioning holes 1202 of a bottom side of the sleeve portion 120, and then the first shielding member 10 is assembled to the second shielding member 12, with cable holder portion 102 gripping the cable 5. Thirdly, insulated cover 6 is molded over the metallic shell 1 and the cable 5 adjacent thereto.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical contact insert for a cable connector assembly, comprising: a set of signal contacts, including at least two differential contact pairs arranged in juxtaposed manner; each of the differential contact pairs including a first signal contact and a second signal contact juxtaposed closely to each other; each of the first signal and second signal contacts having a base portion and a contact engaging portion, and a first side and a second side which are divergent from the base portion to an free end of the contact engaging portion such that a first distance between the base portion of two adjacent differential contact pairs of signal contacts is smaller than a second distance between the contact engaging portion of the same differential contact pairs of signal contacts, wherein a first gap formed between the contact engaging portions of the differential contact pair is equal to a second gap formed between the base portions of the same differential contact pair, wherein a grounding contact has a mating portion disposed between the contact engaging portions of the two differential contact pairs and a tail portion being apart from the base portions of the two differential contact pairs and arranged at a different level, wherein the signal contacts and the grounding contact are integrated with an insulator.

2. The electrical contact insert as recited in claim 1, wherein the first side has a curve surface and the second side has a planar surface.

3. A connector for connecting to at least a cable, comprising: an insulated housing; a plurality of contacts supported by the insulated housing, said contacts including at least two pairs of signal contacts and at least a grounding contact; said signal contacts divided into two juxtaposed differential contact pairs; each of the differential contact pairs including a first signal contact and a second signal contact juxtaposed closely to each other; each of the first and second signal contacts having a retention portion, a mating portion extending forward from the retention portion and a tail portion extending rearward from the retention portion, and a first side and a second side which are divergent from a front segment of the retention portion to an free end of the mating portion such that a first distance between the retention portions of two adjacent differential contact pairs of signal contacts is smaller than a second distance between the mating portions of the same differential contact pairs of signal contacts; and said grounding contact having a mating portion disposed between the mating portions of the two adjacent differential contact pairs, wherein a spacer combined with the contacts is assembled to the insulated housing, wherein the signal contacts and grounding contacts are insert-molded with the spacer, wherein the mating portions of the signal contacts and the grounding contact extend beyond a front face of the spacer, and tail portions of the signal contacts and the grounding contact are respectively located on a top surface and bottom surface of a rear portion of the spacer, wherein the spacer has an inserter portion received in a cavity defined in a rear portion of the insulated housing, wherein two arms extends rearward from lateral sides of a back surface of the insulated housing, wherein a pair of flange portions formed at lateral sides of the spacer are accommodated in guiding passages of the two arms.

4. The connector as recited in claim 3, wherein a tail portion of the grounding contact and the tail portions of the signal contacts are arranged at different levels.

5. The connector as recited in claim 3, wherein a distance formed between each of the differential contact pairs is constant.

6. The connector as recited in claim 3, wherein the insulated housing has a sunken portion defined in the front portion thereof.

7. The connector as recited in claim 6, wherein a plurality of grooves located in the sunken portion to receive the mating portions of the signal contacts and grounding contacts.

8. The connector as recited in claim 3, wherein additional two grounding contacts have mating portions respectively disposed outside of the mating portions of the two differential contact pairs.

9. The connector as recited in claim 8, wherein retention portions of the grounding contacts are interconnected together one another.

10. An electrical connector comprising: an insulative housing defining a mating port; a plurality of signal contacts arranged as differential pairs, disposed in the housing with a juxtaposed manner at a first level, each of said signal contacts including a front mating section and a rear tail section; and a plurality of grounding contacts disposed in the housing essentially at a second level, each of said grounding contacts including a front mating portion and a rear tail portion; wherein the tail sections of the signal contacts and the tail portions of the grounding contacts are located at different planes while the mating sections of the signal contacts and the mating portions of the grounding contacts are located in a same plane under a condition that the mating sections of every adjacent two corresponding differential pairs are separated by the mating portion of the corresponding grounding contact, wherein said grounding contacts are unified together as one piece, wherein a plurality of wires are provided behind the tail sections of the signal contacts and the tail portions of the grounding contacts under a condition that in each of said wires, a pair of signal conductors thereof are mechanically and electrically connected to the tail sections of the corresponding differential pair, and a drain line thereof is mechanically and electrically connected to the tail portion of the corresponding grounding contact.

* * * * *